US005720673A

United States Patent [19]

Anderson

[11] Patent Number: 5,720,673

[45] Date of Patent: Feb. 24, 1998

[54] STRUCTURE AND PROCESS FOR AFFIXING A GOLF CLUB HEAD INSERT TO A GOLF CLUB HEAD BODY

[75] Inventor: Donald A. Anderson, Huntington Beach, Calif.

[73] Assignee: Pacific Golf Holdings, Calif.

[21] Appl. No.: 753,086

[22] Filed: Nov. 20, 1996

Related U.S. Application Data

[63] Continuation-in-part of Ser. No. 259,624, Jun. 14, 1994, which is a continuation of Ser. No. 937,178, Aug. 31, 1992, Pat. No. 5,255,918, which is a continuation-in-part of Ser. No. 897,005, Jun. 11, 1992, Pat. No. 5,261,664, which is a continuation-in-part of Ser. No. 806,348, Dec. 13, 1991, Pat. No. 5,261,663, which is a continuation-in-part of Ser. No. 549,973, Jul. 9, 1990, Pat. No. 5,094,383, which is a continuation-in-part of Ser. No. 492,973, Mar. 13, 1990, Pat. No. 5,024,437, which is a continuation-in-part of Ser. No. 364,698, Jun. 12, 1989, abandoned.

[51] Int. Cl.[6] ..... A63B 53/04

[52] U.S. Cl. ..... 473/342; 473/324; 473/345

[58] Field of Search ..... 473/342, 324, 473/345, 349, 350

[56] References Cited

U.S. PATENT DOCUMENTS

| | | | |
|---|---|---|---|
| 4,618,149 | 10/1986 | Maxel . | |
| 5,024,437 | 6/1991 | Anderson | 473/342 |
| 5,090,702 | 2/1992 | Viste . | |
| 5,094,383 | 3/1992 | Anderson et al. | 473/343 X |
| 5,106,094 | 4/1992 | Desbiolles et al. | 473/342 |
| 5,198,062 | 3/1993 | Chen . | |
| 5,221,087 | 6/1993 | Fenton et al. . | |
| 5,255,918 | 10/1993 | Anderson et al. | 473/342 X |
| 5,261,663 | 11/1993 | Anderson | 473/342 |
| 5,261,664 | 11/1993 | Anderson | 473/342 |
| 5,417,419 | 5/1995 | Anderson et al. | 473/345 X |
| 5,465,968 | 11/1995 | Aizawa et al. | 473/342 |
| 5,509,660 | 4/1996 | Elmer | 473/342 X |

FOREIGN PATENT DOCUMENTS

| | | | |
|---|---|---|---|
| 211781 | 12/1957 | Australia | 53/1 |

*Primary Examiner*—Raleigh W. Chiu
*Attorney, Agent, or Firm*—Page Lohr

[57] ABSTRACT

A golf club head consisting of more than one piece has a joint which holds the pieces together. Characterized by a mechanical interlock, the joint of the invention is formed by preparing a specialized insert with a recess long the periphery of the front side. In addition, a specialized golf club head body includes a ridge of malleable material about a opening operable for receiving the insert. After the insert is placed into the seat in the body, the ridge of malleable material is pushed over and into the recess of the insert. The insert is held fast to the club body and forever and permanently integrated therewith. The joint provides a stronger, cosmetically more attractive, and inexpensive club.

8 Claims, 9 Drawing Sheets

(PRIOR ART MAXEL)

(PRIOR ART CATES)

(PRIOR ART VISTE)

(PRIOR ART FENTON)

(PRIOR ART CHEN)

STRUCTURE AND PROCESS FOR AFFIXING A GOLF CLUB HEAD INSERT TO A GOLF CLUB HEAD BODY

CONTINUING INFORMATION

This application is a continuation-in-part of a previously filed application having a Ser. No. 259,624 and filing date of Jun. 14, 1994; which continues from application having Ser. No. 937,178 filed Aug. 31, 1992 now U.S. Pat. No. 5,255,918; which is a continuation-in-part of Ser. No. 897,005, filed Jun. 11, 1992 now U.S. Pat. No. 5,261,664; which is a continuation-in-part of Ser. No. 806,348, filed Dec. 13, 1991 now U.S. Pat. No. 5,261,664; which is a continuation-in-part of Ser. No. 549,973, filed Jul. 9, 1990, now U.S. Pat. No. 5,094,383, which is a continuation-in-part of Ser. No. 492,973, filed Mar. 13, 1990, now U.S. Pat. No. 5,024,437, issued Jun. 18, 1991; which is a continuation-in-part of Ser. No. 364,698, filed Jun. 12, 1989, now abandoned.

BACKGROUND OF THE INVENTION

1. Field

The instant invention is generally concerned with golf club heads and specifically concerned with golf club heads having inserts, in particular ball striking face inserts, and how those inserts are affixed and held to a golf club head body.

2. Prior Art

A ball striking face of a golf club head may be securely fastened to a golf club head body in several ways. FIG. 1 shows a prior art technique taught in U.S. Pat. No. 4,618,149 where inventor Maxel employs screw fasteners (70, 72) countersunk into the face (77) to attach it to the club head body (40). This technique provides a handsome finish and useful final product.

Inventor Cates provides an attachment means in Australian patent #211,781 which cooperates with a sounding hole (11) shown in FIG. 2. Attachment is affected by way of screw fasteners.

FIG. 3 is comprised of a club taught by Viste in U.S. Pat. No. 5,090,702 having a generally planar face weld attached to a head body at seams (5).

A club shown in FIG. 4 illustrates how a Mr. Fenton employs a wedge device in U.S. Pat. No. 5,221,087 to secure an insert to a club head body. Fenton includes very sophisticated mechanical interlock in a "dovetail" fashion which provides an novel technique for attaching a club face to a club body.

An expert club manufacturer, Mr. Chen teaches an epoxy plus pressure technique which yields a superior strength bond. FIG. 5 shows a club held in a jig so that pressure may be applied.

Certain combinations of the above techniques have also been adopted. For example, some adhesive bonding agents have been used in conjunction with screws. Additionally, some interlocks have been used with welding.

The above identified applicant previously described in patents issued him several techniques for attaching inserts to bodies of golf club heads. FIG. 6 shows a face attached at its periphery (14) as taught in U.S. Pat. No. 5,024,437. FIG. 7 illustrates a preferred screwing technique where a special body (20) is formed with lobes (30, 28) to accommodate receipt of said screws. Details may be found in U.S. Pat. No. 5,261,664. FIG. 8 shows a similar wood type club taught in U.S. Pat. No. 5,261,663 without screws where the face is matingly received into a cavity formed by the club head body. Applicant has used several techniques to fasten inserts to club bodies.

Notwithstanding, techniques have now been discovered which provide very novel methods for attaching a golf club head insert to a golf club head body.

In contrast to the good and useful inventions mentioned above, each having certain features that are no less than remarkable, the instant invention is primarily concerned with forming a mechanical interlock by manipulating malleable metal to hold an insert fast to a club head body. It should be understood that all of the herein referenced materials including prior applications from which this application depends are considered to provide considerable definition of elements of the present invention. Therefore, those materials are incorporated herein by reference.

SUMMARY OF THE INVENTION

Comes now, Donald A. Anderson with an invention including devices for and methods of affixing a golf club head insert to a golf club head body. It is a primary function of this invention to provide a means to secure an insert to a golf club head body. It is a contrast to prior art methods and devices that present systems do not suffer from the failure mechanisms known to trouble alternative techniques and devices.

Briefly, the invention is characterized by a highly unique mechanical interlock. The interlock may be formed in a process having a plurality of steps which sometimes includes:

a) forming a recess about a periphery of a forged insert piece; b) forming a ridge of malleable material along the edge of a golf club head body insert seat; c) placing the insert into the insert seat; d) forcing the malleable material into the recess to hold the club head insert to the club head body. The interlock structure may be characterized by features which include:

a golf club head body having an insert seat and a malleable material which has been pushed over and into a receiving recess on a forged insert.

Devices and methods of the invention may provide a specialized joint which is superior because it is strong, attractive, and inexpensive to produce, among others.

The invention thus stands in contrast to methods and devices known previously.

Objectives of the Invention

It is a primary object of the invention to provide a superior golf club. It is additionally an object to provide a means of joining a club insert to a club body. In addition to these objectives, additional objectives which will become apparent to experts in the field as details are set forth.

A better understanding can be had with reference to the detailed description of preferred embodiments and with reference to the appended drawings. These embodiments represent particular ways to realize the invention and are not inclusive of all ways possible. Therefore, there may exist embodiments that do not deviate from the spirit and scope of this disclosure as set forth by the claims, but do not appear here as specific examples. It will be appreciated that a great plurality of alternate versions are possible.

BRIEF DESCRIPTION OF THE DRAWING FIGURES

These and other features, aspects, and advantages of the present invention will become better understood with regard to the following description, appended claims and drawings where:

PREFERRED EMBODIMENTS OF THE INVENTION

In accordance with each of the preferred embodiments of the invention, there is provided a method of affixing a golf club insert to a golf club body. In addition, there is a product by process; i.e. a golf club head. It will be appreciated that each of the embodiments described include both devices and methods and that the device and method of one preferred embodiment may be different than the device and method of another embodiment.

Figure 1:
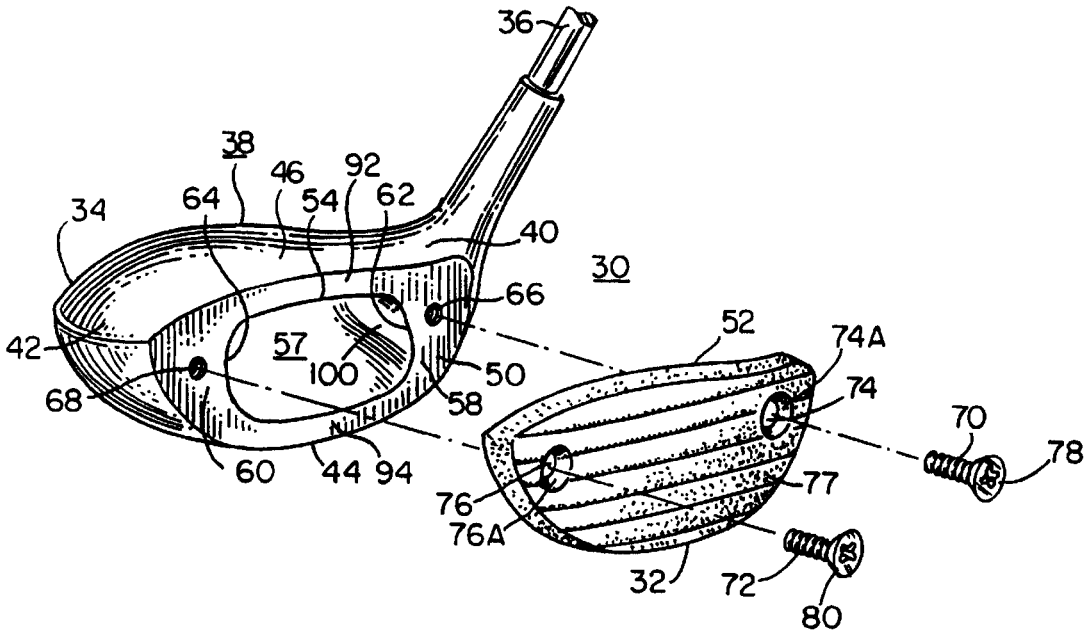
FIGS. 1–5 are prior art figures which relate to insert joining means.
Figure 2:
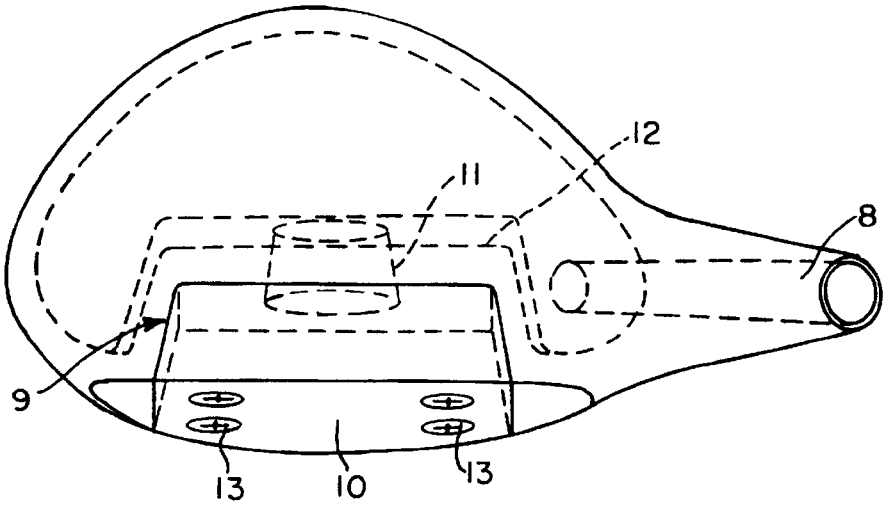
Figure 3:
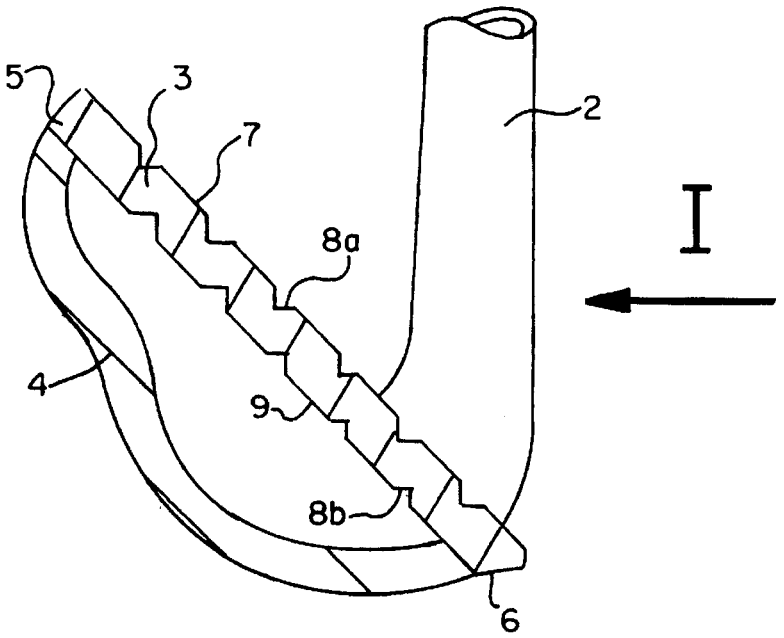
Figure 4:
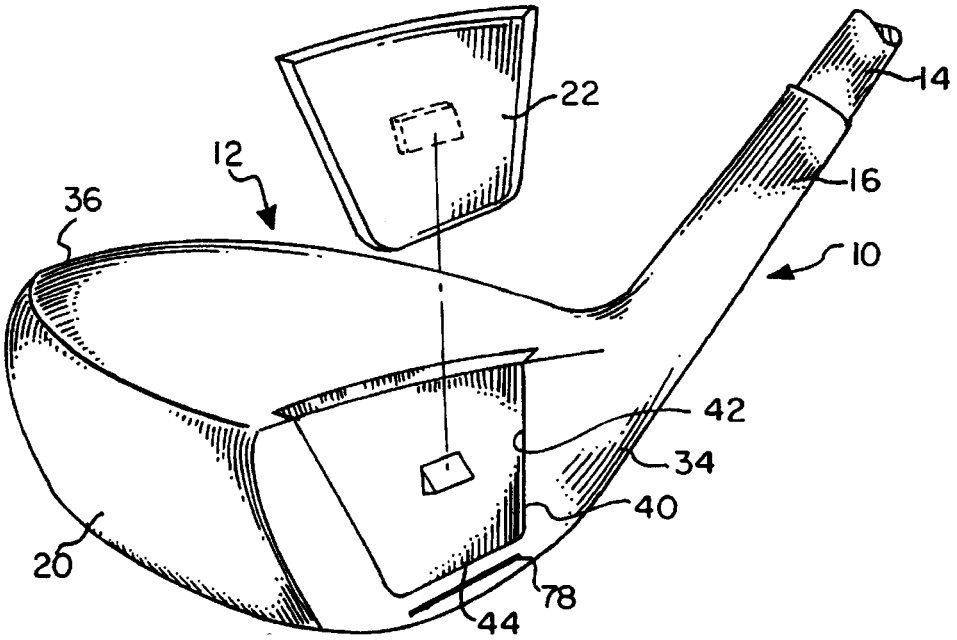
Figure 5:
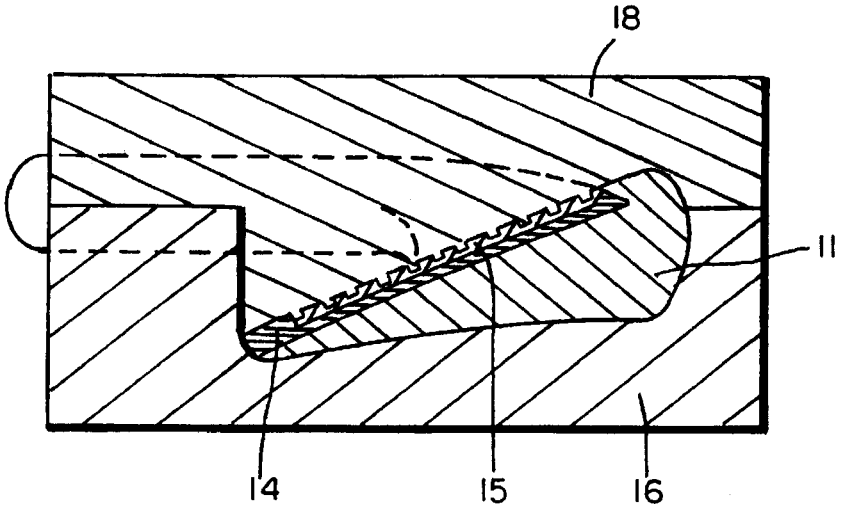
Figure 6:
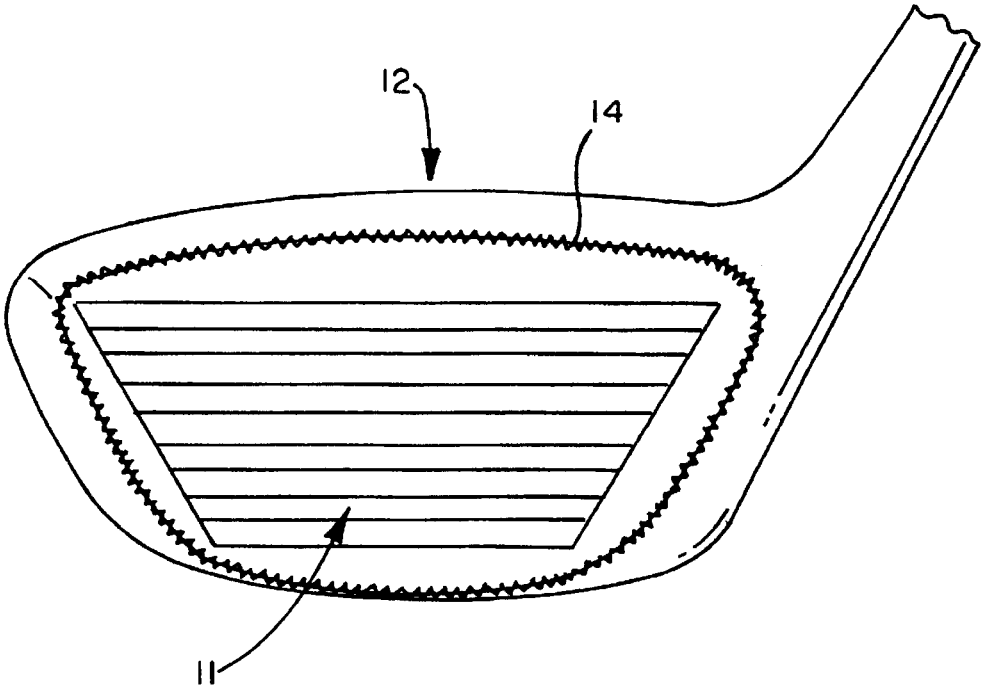
FIGS. 6–8 are figures from clubs invented by the present applicant.
Figure 7:
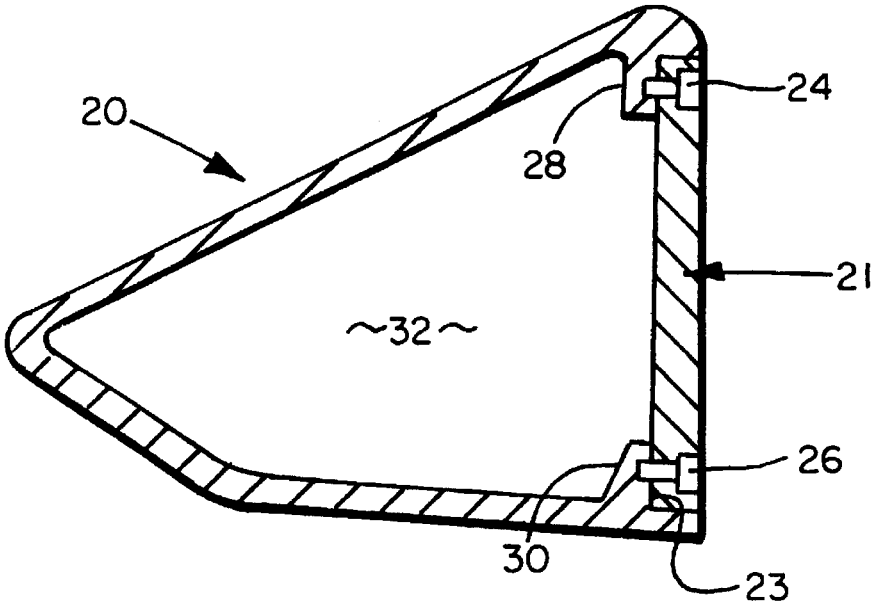
Figure 8:
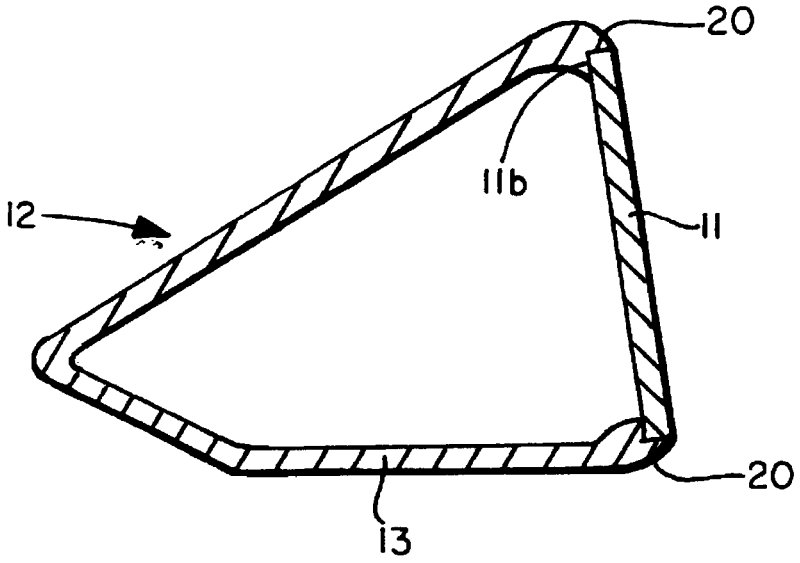
Figure 9:
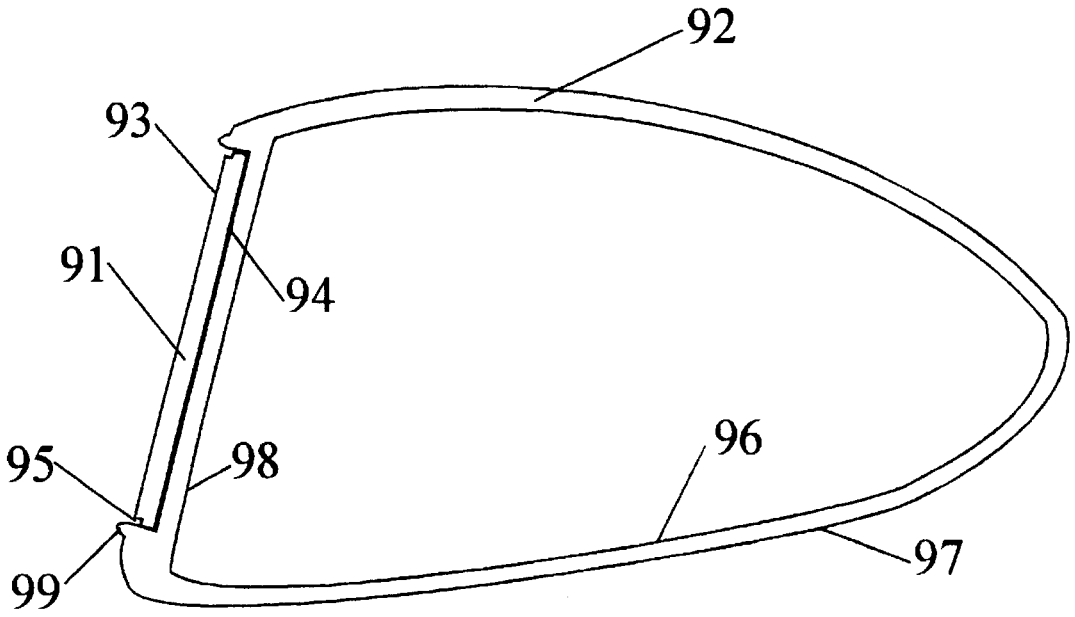
FIG. 9 is a cross section drawing of a wood type club showing a an insert fitted into a receiving cavity of a club body.

With reference to drawing FIG. 9, a golf club head is shown in cross section. The head may be comprised of two parts; a first part being an insert 91 and a second part being a head body 92. An insert is generally a single element which may be planar or curved. Sometimes it is preferably formed of metallic material in a forging process. Forging tends to provide desirable properties which cooperate well with the objectives of a golf club face. It has a front surface 93 and a back surface 94. It may have fine features such as a recess 95 about its periphery at the front surface.

Figure 10:
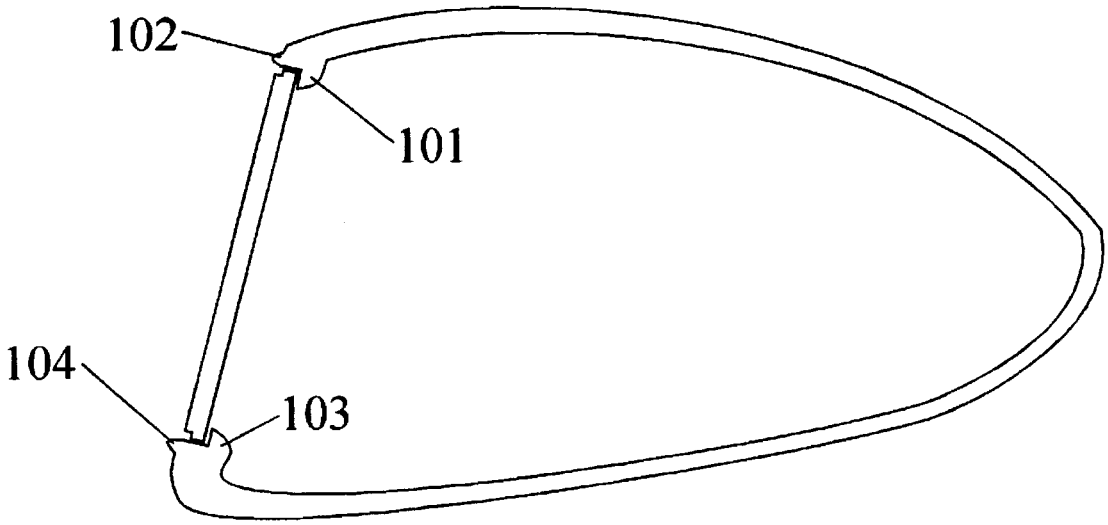
FIG. 10 is a close-up view of a region where an insert periphery meets the material of the club body.

The body may be similarly comprised of a metallic material. Since the body may be of a complex shape, it may be preferably constructed in a casting process where a mold is used. Cast metals have properties which support well the many objectives of a golf club body. A body may have an interior surface 96 and an exterior surface 97. Sometimes the body of the club may include a support wall 98 at the front of the body which can receive an insert thereon. More typically, the face is left open to facilitate the casting process which does not work well with enclosed volumes. The front of a club body of the invention is fashioned to receive an insert. The construction is herein called an insert seat. An annular opening may form an insert seat into which the insert may be set. FIG. 10 shows a preferred configuration where the front of the club body is open and is comprised of such insert seat. Lobes of material show in cross section as 101 and 103 form a seat for the insert. The seat extends about an opening in the club head body at the front portion thereof. The thickness and shape of the lobe may be highly variable. However, the portion which engages an insert is generally flat to accommodate the back surface thereof. If the back surface is curved, then the seat may be arranged in a complementary shape to accommodate the insert. The body is additionally prepared with material in the form of a annular ridge shown as lobes 102 and 104 in the cross section drawing. The material is malleable and can be formed into various shapes under applied pressure. The ridge is located on the face of the body in a manner which allows the edges of the insert to pass the ridge as it is inserted into the insert seat of the body. The lateral extent of the insert and the opening in the face of the body are preferably similar size such that the insert fits snugly into the seat formed in the body.

Figure 11:
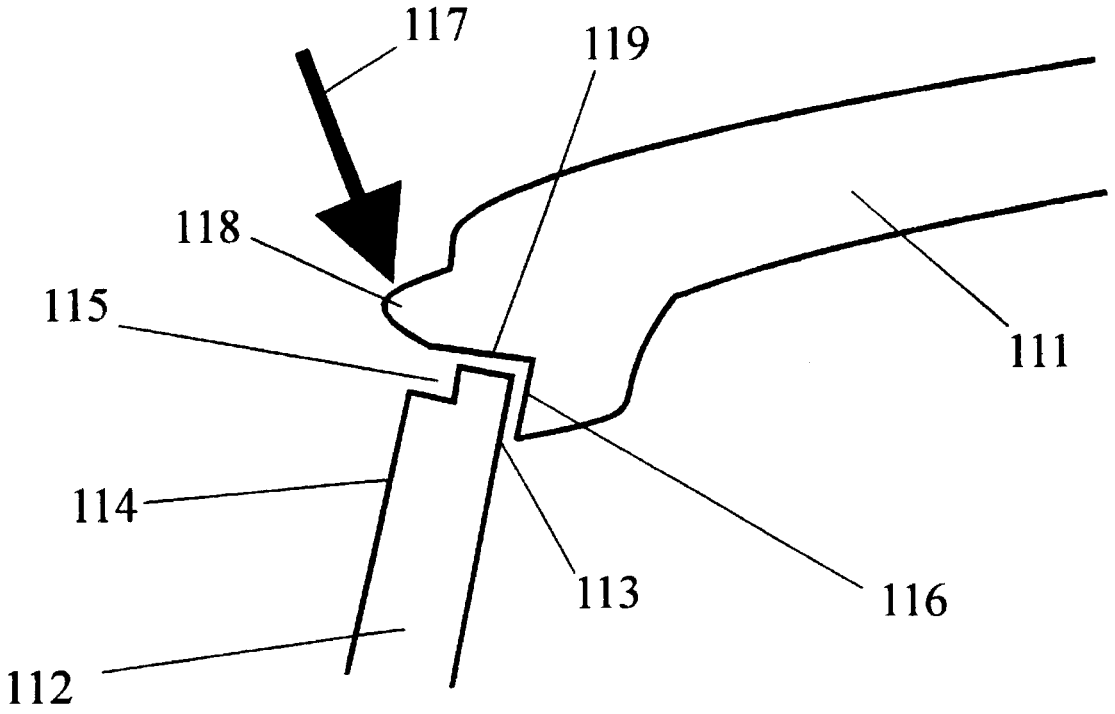
FIG. 11 shows pressure being applied to malleable material in a fashion to push the material into a recess along the periphery of the insert.

FIG. 11 shows a magnified view of the cooperation between the insert 112 and the body 111. The backside of the insert 113 may be in close proximity to the insert seat 116 and 119 formed in the body. The drawing is show with space therebetween for clarity, however, it is to be understood that the insert could actually be in contact with the seat. A recess 115 about the periphery of the insert on its front surface 114 may be of various shapes. It is shown in the figure in cross section as a simple rectangular groove. It may be symmetric about the entire edge of the insert, or it may exist periodically on certain portions thereabout. Malleable material in the form of a ridge 118 about the opening of the body will allow the insert to be fitted into the insert seat. The material is operable for being pushed into the space 115 between the insert and the body. A force 117 applied to the ridge will tend to move it into the recess of the insert.

Figure 12:
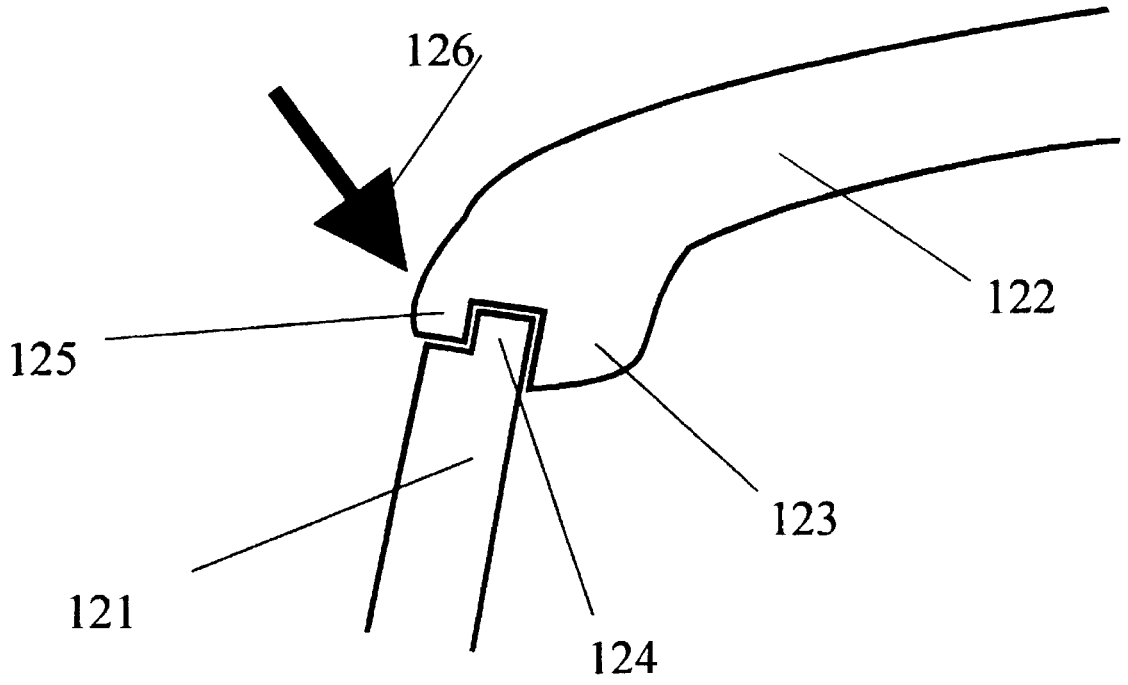
FIG. 12 shows a dashed line along which a grinding process may form a smoothed transition between the insert and body.
Figure 13:
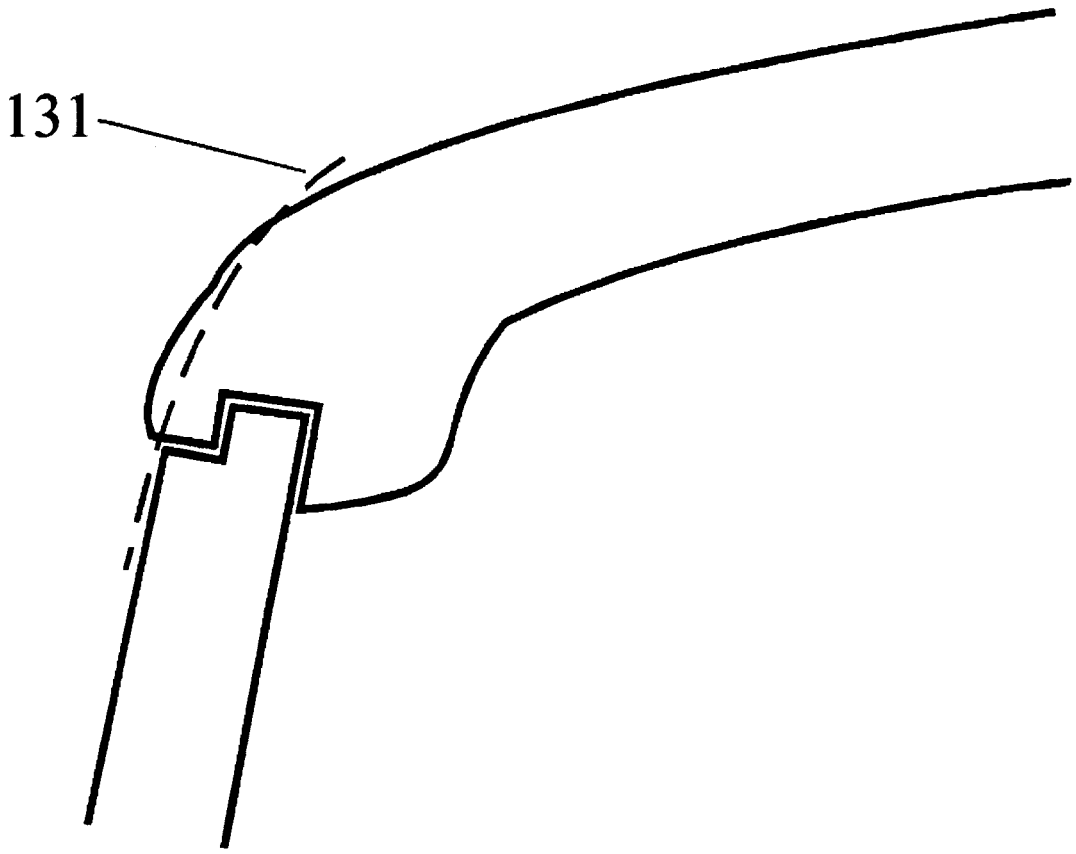
FIG. 13 shows a finishing step which improves the cosmetics of a manufactured club.

FIG. 12 shows the material having been pushed into the recess by continued force 126. As the material occupies the space of the recess, the face 121 is held fast to the body 122. The periphery 124 of the insert will no longer pass the malleable material 125 which has taken a new shape and position. The seat 123 remains in place to prevent the insert from moving further into the interior of the club body. For cosmetic purposes, one may wish to grind the material of the body and face together to form a smooth joint. FIG. 13 shows a dashed line along which serves as a guide for a grinding step. So formed, the material tends to hold the insert into the seat and prevents it from being separated from the body. At this point, the amalgamation may be heat treated or annealed for additional strengthening or simply left as formed.

The description above sets forth the best mode anticipated by the inventor. Many other versions are believed to exist. These versions being equally as useful as the one presented, are considered to be included as part of the entire disclosure. The following general description sets forth features which characterizes many of these versions.

Although the present invention has been described in considerable detail with clear and concise language and with reference to certain preferred versions thereof including the best mode anticipated by the inventor, other versions are possible. Therefore, the spirit and scope of the appended claims should not be limited by the description of the preferred versions contained therein.

Accordingly, it is claimed:

1. A golf club head formed of at least two pieces including: a golf club head insert and a golf club head body, said golf club head insert being held fast to said golf club head body by a mechanical interlock, said mechanical interlock being formed by applying pressure to a ridge of malleable material to force it into intimate contact with said golf club head insert along a recess thereon.

2. A golf club head of claim 1, said golf club head insert being formed of a metallic material in a forging process and said golf club head body being formed of a metallic material in a casting process.

3. A golf club head of claim 1, said ridge of malleable material being formed on said golf club head body.

4. A golf club head of claim 1, said golf club head insert being formed of a metallic material in a forging process, further being substantially planar or slightly curved having front and back surfaces and a closed loop periphery, and having a recess formed along the periphery of the front surface.

5. A golf club head of claim 1, said golf club head body of a metallic material formed in a casting process, further having a face portion which is partially open having an insert seat formed therein said face portion operable for receiving said golf club head insert therein.

6. A method of forming a golf club head formed of at least two pieces, a first piece being a golf club head insert and a second piece being a golf club head body, the two pieces being mechanically interlocked together, the method comprising the steps:

a) forming a recess about a periphery of a golf club head insert;

b) forming a ridge of malleable material along the edge of a golf club head body insert seat;

c) placing the insert into the insert seat; and d) forcing the malleable material into the recess to hold fast the club head insert to the club head body.

7. A method of claim 6 having the additional step of grinding the mechanical interlock to form a smooth transition from the golf club head body to the golf club head insert.

8. A method of claim 6, the golf club head insert being a metallic material formed from a forging process and the golf club head body being a metallic material formed from a casting process.

* * * * *